US011406233B2

(12) United States Patent
Painter

(10) Patent No.: US 11,406,233 B2
(45) Date of Patent: Aug. 9, 2022

(54) APPARATUS FOR PROTECTIVELY COVERING A TOILET BOWL, AND METHOD OF USING SAME

(71) Applicant: Paul W. Painter, Harrison Township, MI (US)

(72) Inventor: Paul W. Painter, Harrison Township, MI (US)

( * ) Notice: Subject to any disclaimer, the term of this patent is extended or adjusted under 35 U.S.C. 154(b) by 37 days.

(21) Appl. No.: 17/204,031

(22) Filed: Mar. 17, 2021

(65) Prior Publication Data

US 2021/0290007 A1 Sep. 23, 2021

Related U.S. Application Data

(60) Provisional application No. 62/991,849, filed on Mar. 19, 2020.

(51) Int. Cl.
*A47K 13/16* (2006.01)
*A47K 13/24* (2006.01)

(52) U.S. Cl.
CPC ..... *A47K 13/16* (2013.01); *A47K 13/24* (2013.01)

(58) Field of Classification Search
CPC ..... A47K 13/16; A47K 13/14; A47K 13/24
USPC ..... 4/234
See application file for complete search history.

(56) References Cited

U.S. PATENT DOCUMENTS

| | | | | |
|---|---|---|---|---|
| 6,108,827 | A * | 8/2000 | Espadas | A47K 13/242 4/253 |
| 9,009,875 | B2 * | 4/2015 | Smashey | A47K 13/242 4/253 |
| 2003/0024038 | A1 | 2/2003 | Cross et al. | |
| 2006/0053541 | A1 | 3/2006 | Howard | |
| 2007/0250997 | A1 | 11/2007 | McDonald et al. | |
| 2009/0049591 | A1 | 2/2009 | Orona, Jr. | |
| 2012/0278982 | A1 * | 11/2012 | Rogers | E03D 9/00 4/242.1 |

* cited by examiner

*Primary Examiner* — Huyen D Le
(74) *Attorney, Agent, or Firm* — Carrier Blackman & Associates, P.C.; William D. Blackman; Joseph P. Carrier

(57) ABSTRACT

A toilet bowl cover apparatus, for use on a toilet having a toilet bowl and a seat, includes an arcuate frame member configured to surround or fit on top of the toilet bowl below the seat. The cover apparatus also includes a flexible plastic sheet member having a shape configured to fit on the frame member, the sheet member having an upper side and a lower side with a sticky adhesive material thereon. The cover apparatus is configured to adhesively attach to an upper surface of the toilet bowl, in order to substantially seal the bowl and minimize water evaporation from the bowl during periods of non-use.

17 Claims, 10 Drawing Sheets

FIG-8

STOP / ALTO

NOT IN SERVICE- When Present

This Side Up

Installs just under the Seat - On top of Bowl

Do Not Remove This Label

Bowl Guard is to cover Toilets Only!
This is not a toy. Do Not Allow Children to Use or Play with!

! CAUTION !

The Bowl Guard Wire is Spring Loaded

Do Not Cut Film or Remove or Cut the Safety Line.

This Cover has adhesive on one side and may stick to any object! Discard after use. PueHoe Bowl Guard™

WWW.BOWLGUARD.COM

Always Handle with Protective Gloves. Made in USA

APPARATUS FOR PROTECTIVELY COVERING A TOILET BOWL, AND METHOD OF USING SAME

CROSS-REFERENCE TO RELATED APPLICATIONS

This application is based upon, and claims priority from U.S. Provisional Patent Application No. 62/991,849, filed Mar. 19, 2020. The entire contents of the referenced priority application are incorporated herein by reference.

BACKGROUND OF THE INVENTION

1. Field of the Invention

The present invention relates to a temporary cover apparatus for a toilet bowl, for protectively and temporarily sealing the bowl during a period of non-use. More particularly, the present invention relates to a temporary cover apparatus including a frame member and an adhesive sheet adapted for placement over a toilet bowl to seal water inside of the bowl in order to minimize evaporation therefrom.

2. Description of the Background Art

Sometimes individuals have a second home or vacation cottage which is used during certain time periods, and which is kept vacant during other periods such as, for example, used during the summer and kept vacant during the winter season.

If these homeowners leave an unused toilet uncovered during periods of non-use, problems may arise if all water in the bowl of such toilet completely evaporates. Such evaporation may create a path for sewer gases to enter the home, and in addition, the open plumbing pipe may allow invasive creatures, such as insects, reptiles, rodents or other animals to enter the unoccupied home from the sewer or septic system.

Such individuals may wish to seal a toilet bowl during periods of non-use, in order to minimize or prevent evaporation, and also to avoid any risk of insects, animals or sewer gases exiting the bowl.

In other situations, plumbers, janitors or maintenance workers may wish to temporarily cover a toilet bowl of a toilet which is temporarily out of order, and further may wish to clearly mark the incapacitated toilet as out of use. This need may be especially important in situations where human waste, which cannot be removed, is present, such as where the toilet has been used but cannot be flushed. A number of different protective covers are known for use on toilets when such toilets are temporarily unusable.

Examples of some of the known toilet covers include those described in published patent application US 2003/0024038, published patent application US 2006/0053541, published patent application US 2007/0250997, and published patent application US 2009/0049591. In addition, packages of "peel and stick" toilet bowl covers, for winterizing unused toilets, are on sale and commercially available from the US Hardware Supply company, at the web page www.ushardwaresupply.com/toilet-winterization.aspx.

Although the known toilet bowl covers are useful for their intended purposes, a need still exists in the art for an improved toilet bowl cover which is durable, quick and easy to install, relatively inexpensive, and simple to use.

SUMMARY OF THE INVENTION

Accordingly, it is an object of the present invention to provide an improved apparatus for protectively covering a toilet bowl during periods of non-use.

A toilet bowl cover apparatus according to a first aspect of the invention is provided for use on a toilet having a toilet bowl and a seat.

The toilet bowl cover apparatus according to the first aspect includes an arcuate frame member configured to surround or fit on top of the toilet bowl below the seat. The frame member may be formed substantially in a U-shape, having a first end and a second end.

The cover apparatus also includes a flexible plastic sheet member having a shape configured to fit on the frame member, the sheet member having an upper side and a lower side with a sticky adhesive material thereon. The sheet member may be provided as a translucent tinted sheet. Alternatively, the sheet member may be provided as an opaque sheet.

Optionally, the apparatus may include a peel-away cover sheet covering the adhesive side of the sheet member. Where used, such peel-away cover sheet is removed before installation.

Outer edge portions of the sheet member are wrapped around the frame member and attached to the lower side of the sheet member.

The cover apparatus is configured to adhesively attach to an upper surface of the toilet bowl, in order to substantially seal the bowl and minimize water evaporation from the bowl during periods of non-use.

Optionally, the sheet member may have indicia such as writing on the upper surface thereof. Such indicia may include the words Winterized, Do Not Use, and/or Out of Order.

The present invention also provides a method of attaching the cover apparatus to a toilet bowl below a seat.

A more complete description of the present invention is provided in the following detailed description section, which should be read in conjunction with the accompanying drawings. Throughout the following detailed description and in the drawings, like numbers refer to like parts.

BRIEF DESCRIPTION OF THE DRAWINGS

FIG. 8 is a plan view of a warning label usable as a component of a toilet bowl cover apparatus according to the invention.

DETAILED DESCRIPTION

Figure 1:
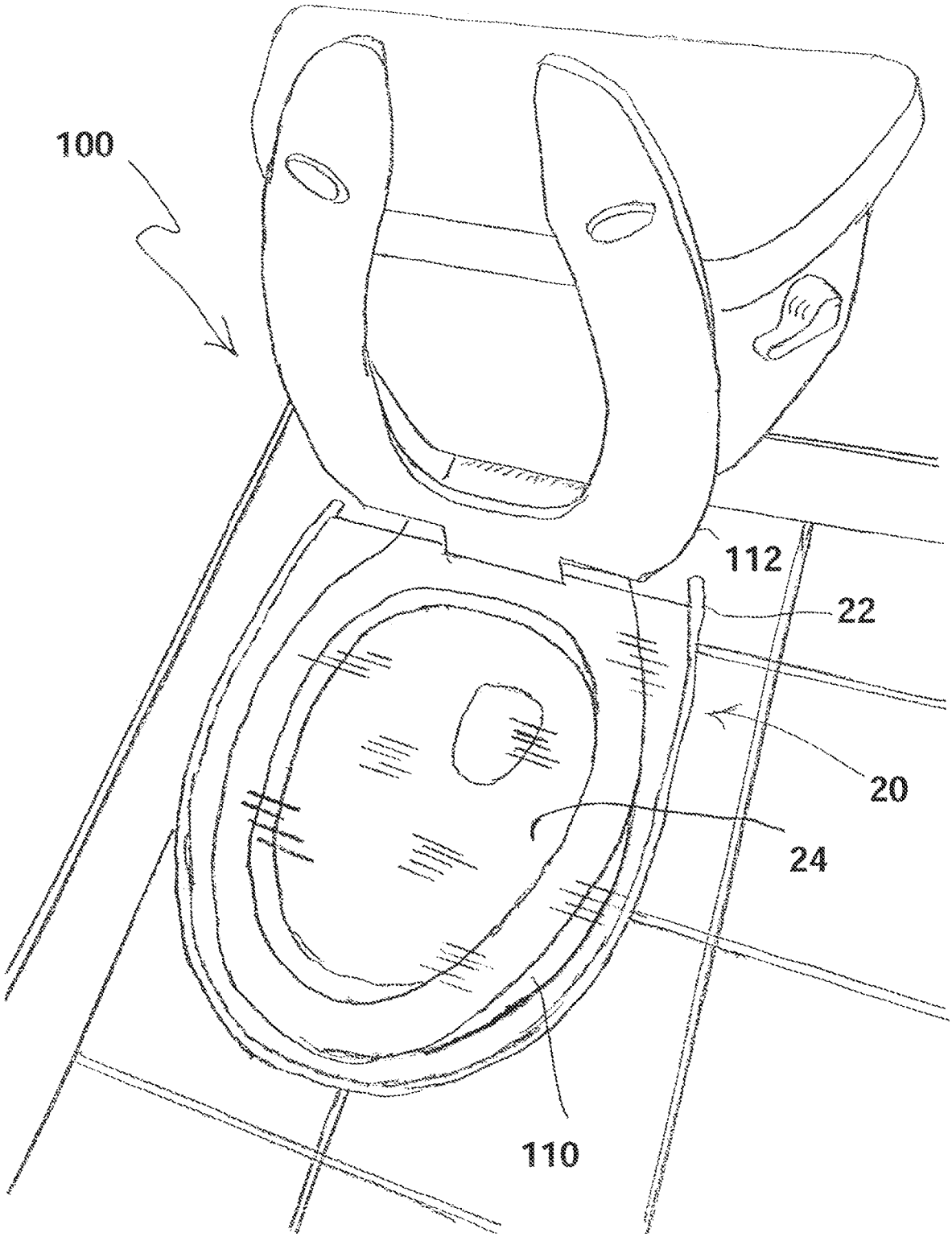
FIG. 1 is a perspective environmental view showing a toilet bowl cover apparatus according to an illustrative embodiment of the present invention installed on a toilet.
Figure 2A:
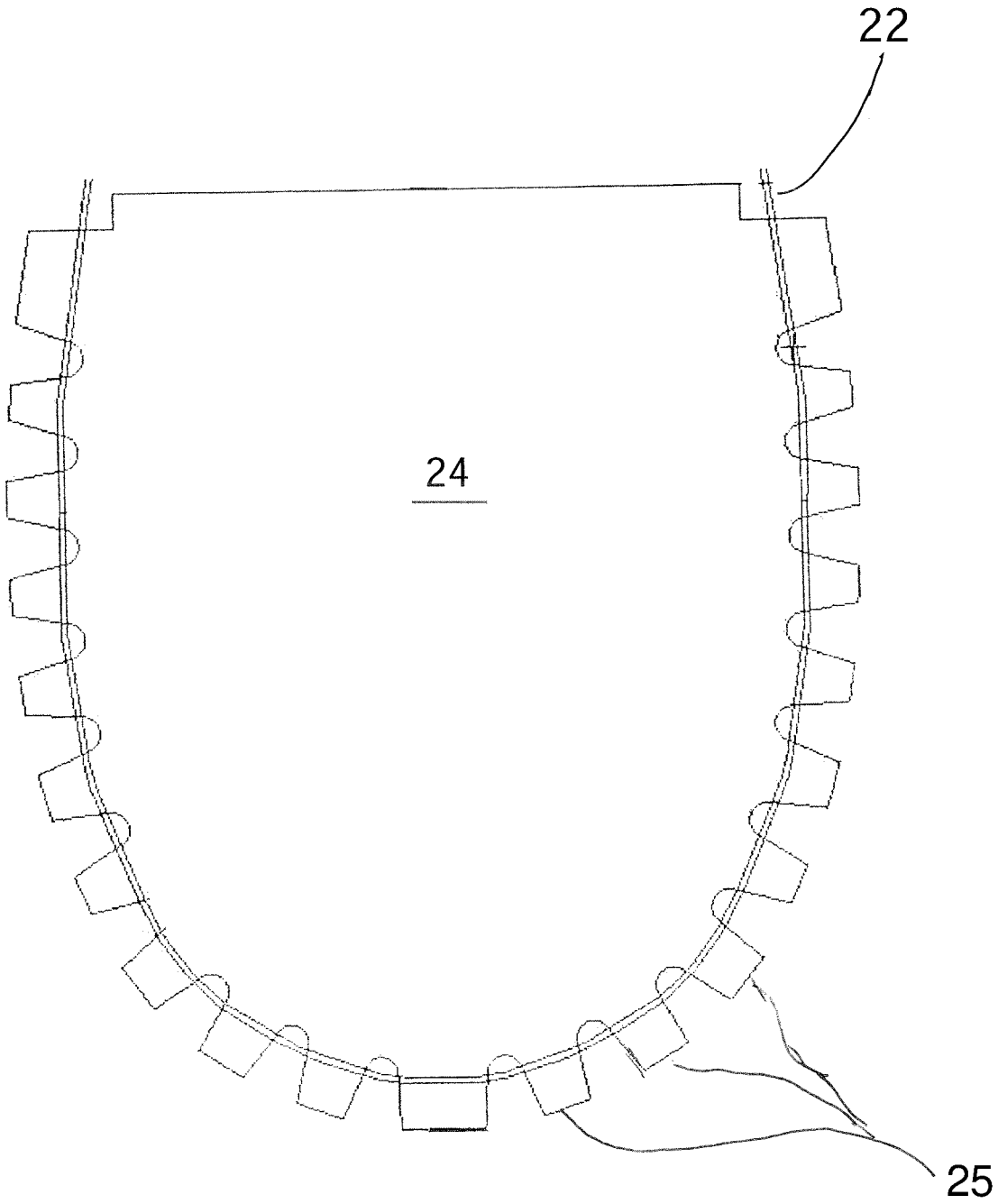
FIG. 2A is a top plan view of component parts used to form a toilet bowl cover apparatus according to a first illustrative embodiment of the present invention.
Figure 2B:
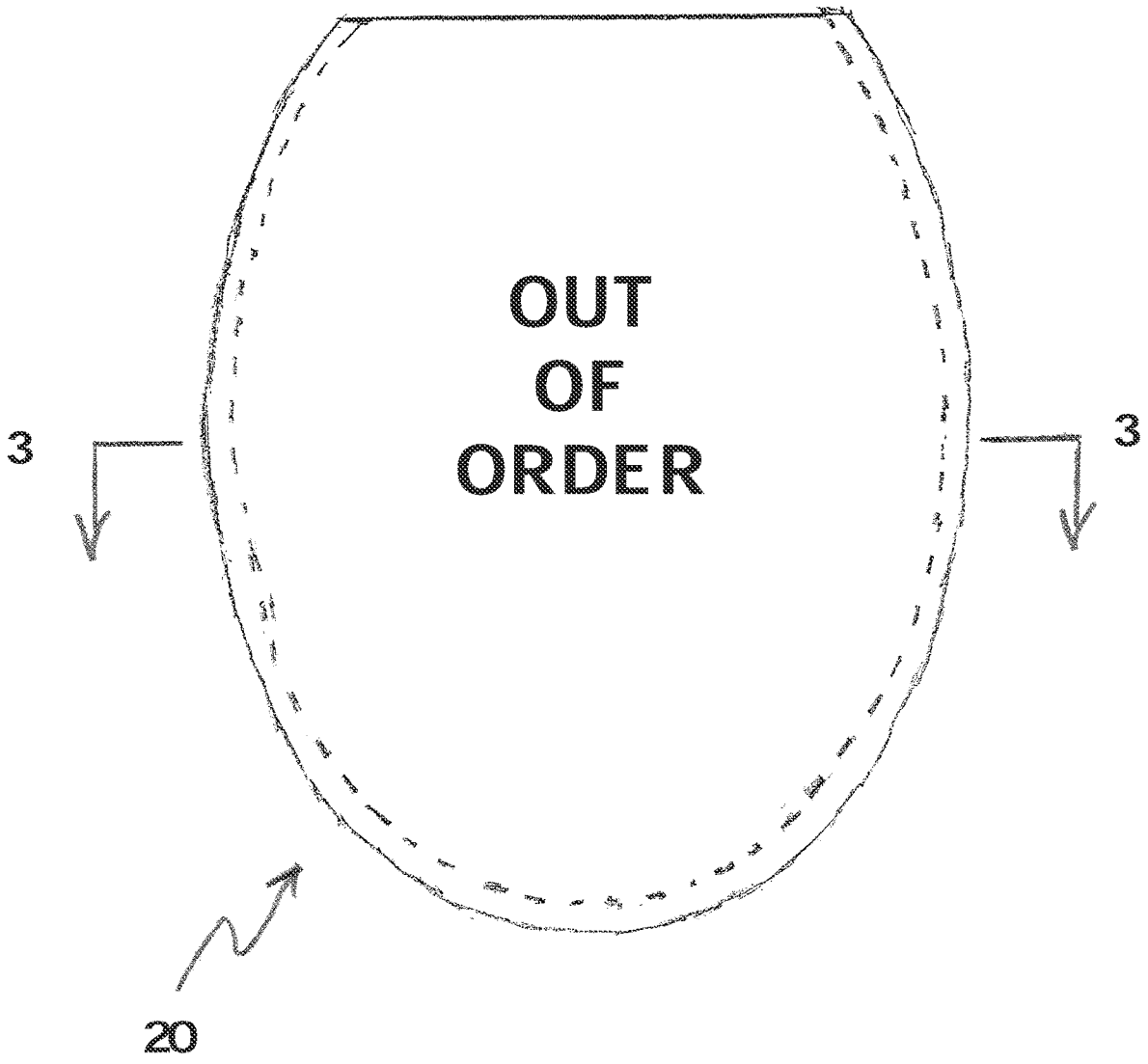
FIG. 2B is a top plan view of a toilet bowl cover apparatus according to a first illustrative embodiment of the present invention.

Referring now to FIGS. 1 and 2A-2B, a toilet bowl cover apparatus 20 according to a first embodiment of the invention is shown in an installed configuration on a toilet 100 having a toilet bowl 110 and a seat 112. The cover apparatus 20 is configured to adhesively attach to an upper surface of the toilet bowl 110, in order to substantially seal the bowl and minimize water evaporation from the bowl during periods of non-use.

Such period of non-use may be during a time period when a building is temporarily unoccupied, such as a winter season for a vacation home which is used only in the summer.

Alternatively, such period of non-use may be due do a temporary malfunction of the toilet 100 or its associated plumbing, such as in a public restroom having multiple stalls, one of which is out of order.

Figure 4:
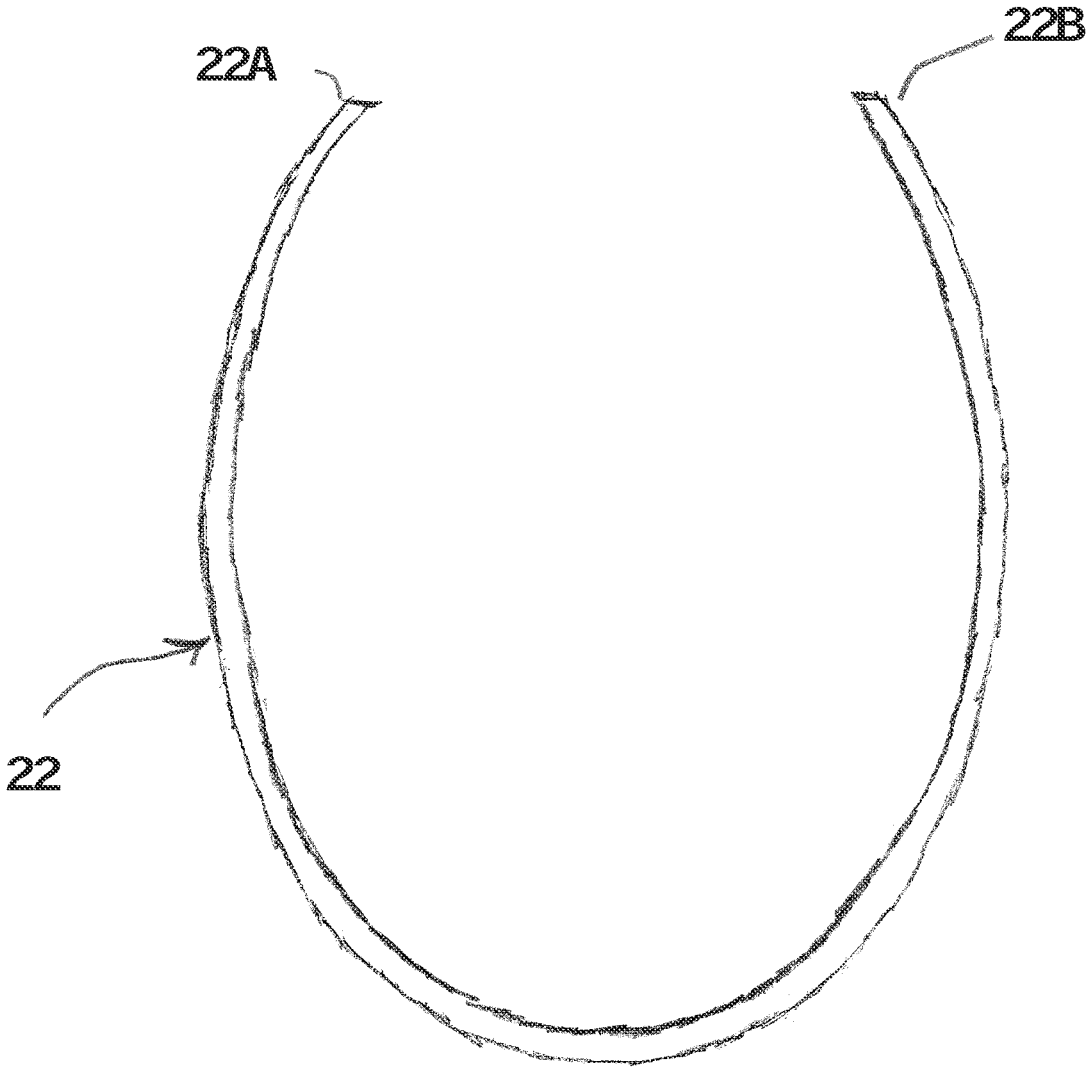
FIG. 4 is a top plan view of a frame member which is a component of the toilet bowl cover apparatus of FIG. 1.

The toilet bowl cover apparatus 20 according to the first embodiment includes an arcuate frame member 22, configured to surround the toilet bowl 110 when the apparatus is installed on the toilet bowl below the seat 112. As shown in FIG. 4, the frame member 22 may be formed substantially in a horseshoe shape or a U-shape having a first end 22A and a second end 22B.

The frame member 22 may be formed from a metal wire such as, for example, steel.

Alternatively, the frame member 22 may be formed from a flexible, resilient plastic such as Nylon, or from a relatively rigid plastic material.

Optionally, a wire or cable (not shown) may be used to interconnect the ends 22A, 22B of the frame member 22.

The cover apparatus 20 also includes a flexible plastic sheet member 24 having a shape configured to fit on the frame member 22, the sheet member having an upper side 26 and a lower side 28 with a sticky adhesive material thereon.

Figure 5:
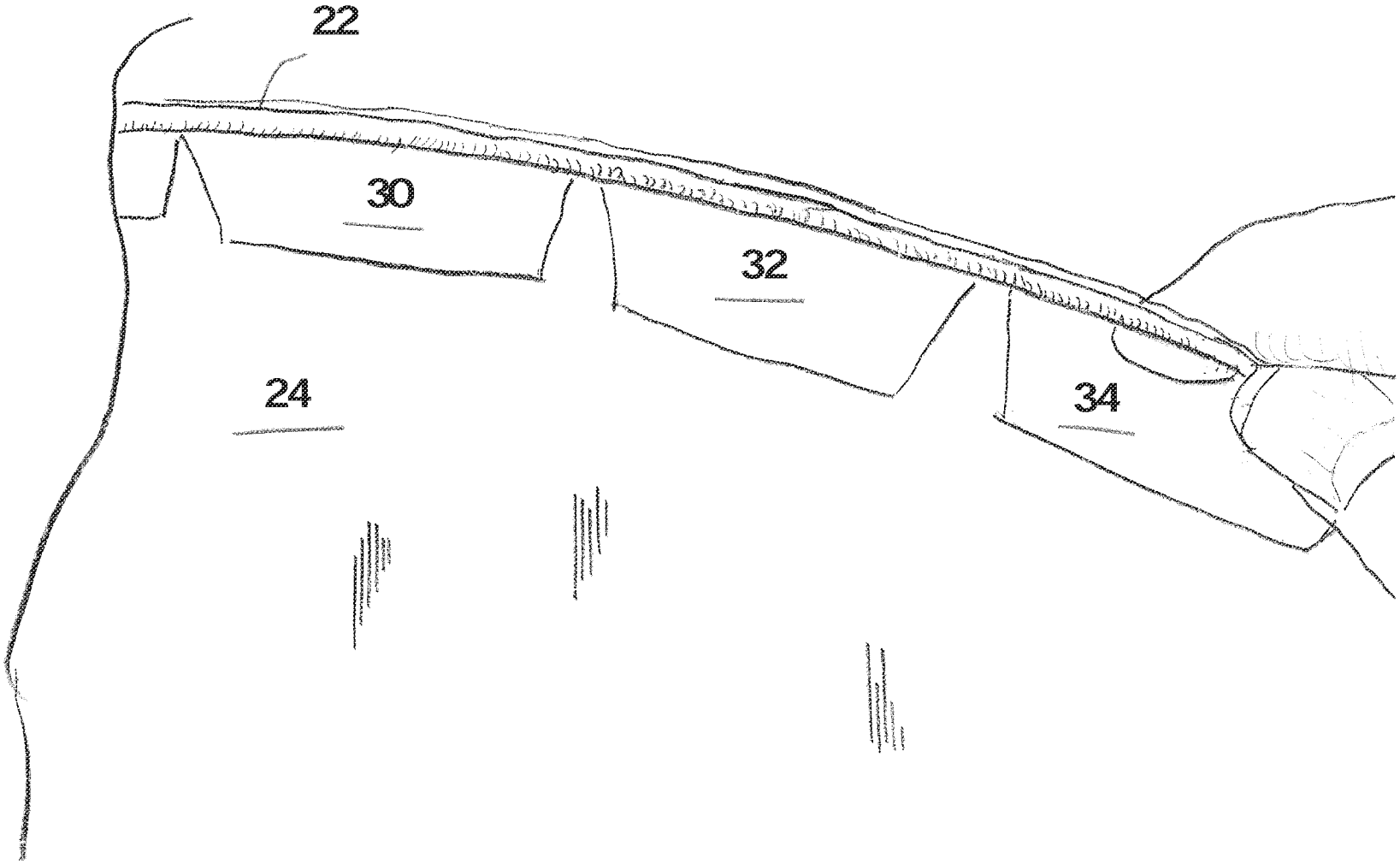
FIG. 5 is a detail perspective view of an edge portion of the toilet bowl cover apparatus of FIG. 1.

The sheet member 24 is cut with a specified radius for going around the cylindrical frame member, and this helps prevent the formation of stress points that may cause the film to rip. Outer edge portions of the sheet member 24, such as those shown at 30, 32 and 34 in FIG. 5, are are formed as a plurality of outwardly extending tabs 25 which are wrapped around the frame member 22 and attached to the lower side 28 of the sheet member.

Optionally, the sheet member may have indicia such as writing on the upper surface thereof. Such indicia may include the words Winterized, Stop, Do Not Use, and/or Out of Order.

The sheet member 24 may be provided as a translucent tinted sheet allowing a selected level of visibility, such as approximately 35% light transmittance, which reduces the light by an amount sufficient to prevent algae growth inside of the toilet bowl 110.

Alternatively, the sheet member 24 may be provided as an opaque sheet. The apparatus may include a peel-away cover sheet 36 covering the adhesive lower side 28 of the sheet member 24. Where used, this peel-away cover sheet 36 is removed before installation, to allow the sheet member 24 to removably stick to the upper surface of the toilet bowl 110.

Method of Installation

For installation, if a protective cover sheet 36 is provided on the sheet member 24, such cover sheet is removed. The upper surface of the toilet bowl 110 is cleaned using toilet paper, a tissue or the like.

Then, the cover apparatus 20 is aligned over the toilet bowl's upper surface with the adhesive side 28 facing downwardly.

Once the cover apparatus 20 has been aligned with the toilet bowl, the cover apparatus is placed on and pressed against the upper surface of the toilet bowl 110, in a manner such that the sheet member 24 sticks to, and becomes sealingly attached to the upper surface substantially around the entire periphery of the toilet bowl 110.

Second Embodiment

Figure 6:
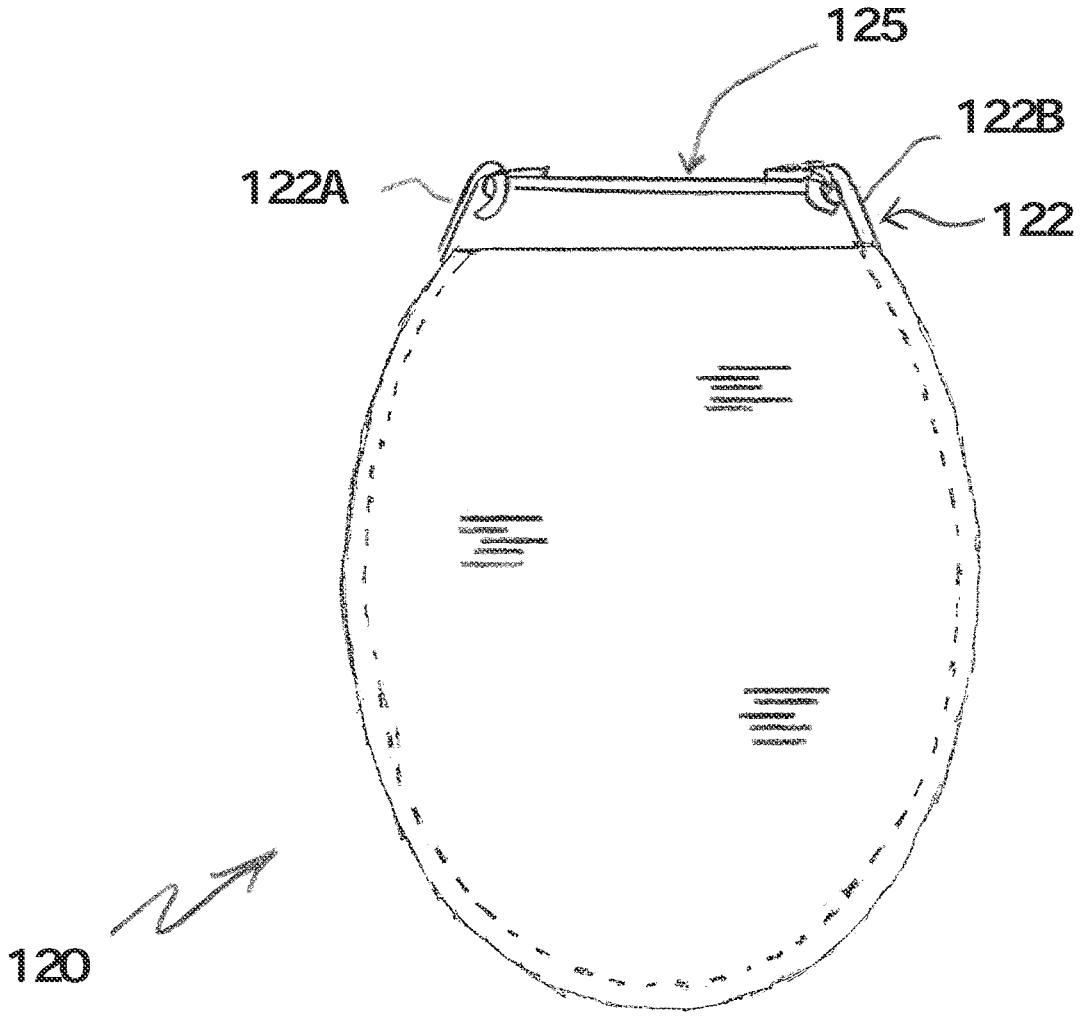
FIG. 6 is a top plan view of a toilet bowl cover apparatus according to a second illustrative embodiment of the present invention.
Figure 7A:
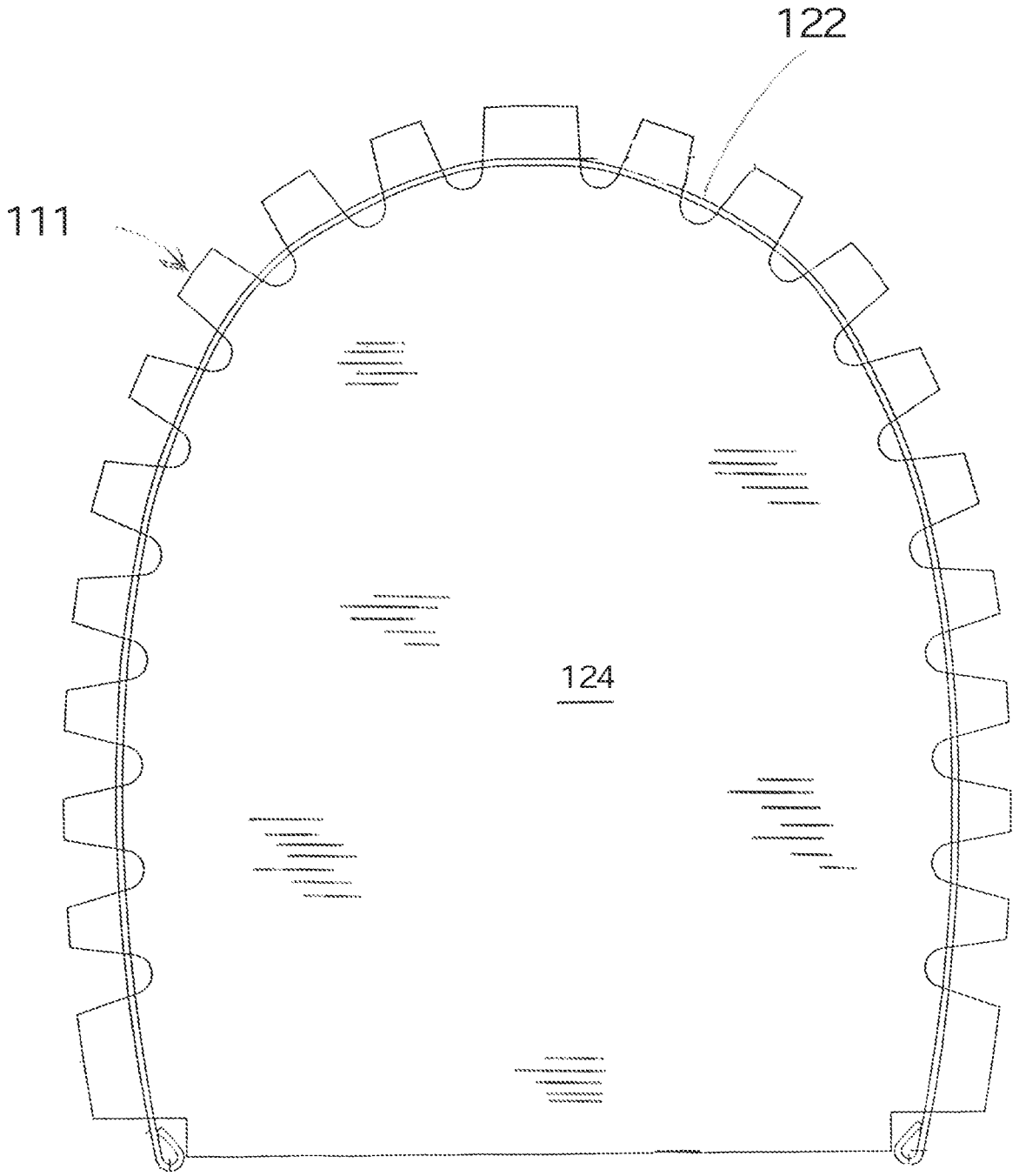
FIG. 7A is a top plan view of component parts used to form a toilet bowl cover apparatus according to a second illustrative embodiment of the present invention.
Figure 7B:
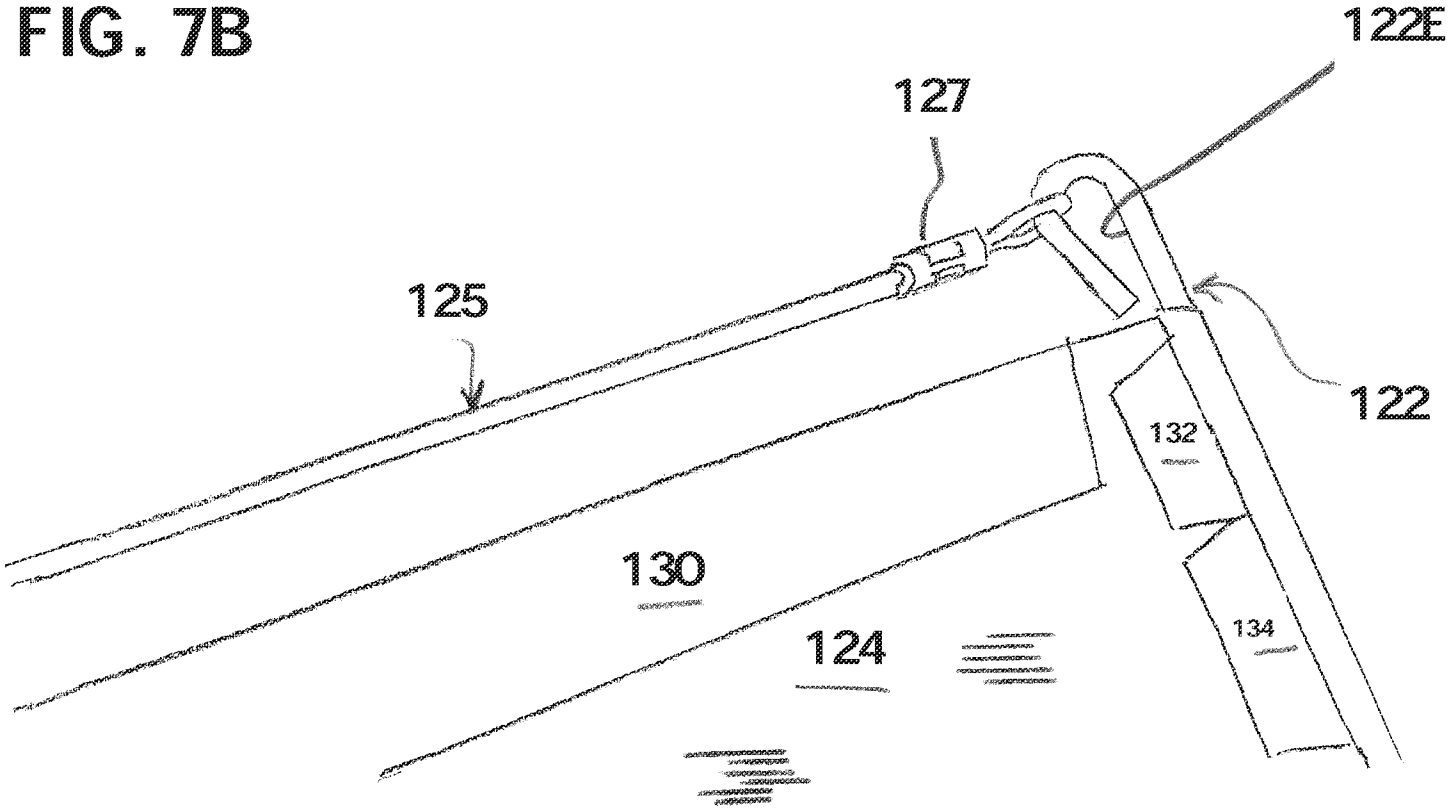
FIG. 7B is a detail perspective view of an edge portion of the toilet bowl cover apparatus of FIG. 6.

Referring now to FIGS. 6-7B as well as FIG. 1, a toilet bowl cover apparatus 120 according to a second embodiment of the present invention includes an arcuate frame member 122, configured to surround the toilet bowl 110 when the apparatus is installed on the toilet bowl below the seat 112. The frame member 122 may be formed substantially in a horseshoe shape or a U-shape, as shown, having a first end 122A and a second end 122B.

Each of the first and second ends 122A, 122B is bent around in a closed U-shape to form an eyelet, such as the eyelet 122E shown in the detail view of FIG. 7B. This eyelet 122E is provided to protect users from getting injured by the tip end of the frame member 122, and the eyelet also provides a point of attachment for a safety line 125, discussed in further detail below.

The frame member 122 according to the second embodiment may be formed from flexibly resilient spring steel. Alternatively, the frame member 122 may be formed from a flexible, resilient plastic such as Nylon.

In this second embodiment, a wire or cable is used as a safety line 125 to interconnect the ends 122A, 122B of the frame member 122. As shown in FIG. 7B, each end of the safety line 125 is passed through the corresponding eyelet 122E, and is attached to itself by a crimp connection 127 to form a loop, thereby connecting the safety line to the frame member 122. By interconnecting the ends of the frame member in this way, the safety line 125 retains the "springy" frame member 122 in its horseshoe shape.

Figure 3:
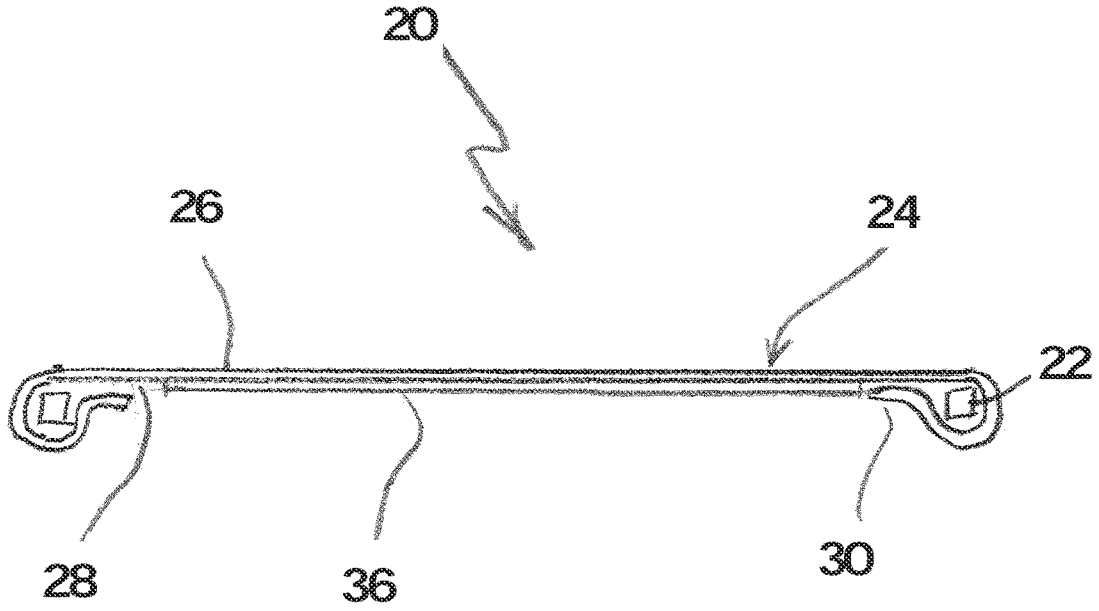
FIG. 3 is a sectional view of the apparatus of FIGS. 1-2B, taken along the line 3-3 in FIG. 2B.

The cover apparatus also includes a flexible plastic sheet member 124 having a shape configured to fit on the frame member 122, the sheet member having an upper side 126 and a lower side 128 with an adhesive material thereon, similar to the sheet member 24 of the first embodiment as previously described and shown in FIG. 3. In this embodiment, the wire spring loaded frame member 122 provides a drum-like effect on the plastic sheet member 124 and keeps tension on the plastic sheet member.

The film making up the sheet member 124 is cut with a specified radius for going around the cylindrical frame member 122, and helps prevent the formation of stress points that may cause the film to rip.

Outer edge portions of the sheet member 124, such as those shown at 130, 132 and 134 in FIG. 5, are formed as a plurality of outwardly extending tabs 111, which are wrapped around the frame member 122 and attached to the lower side 128 of the sheet member during assembly.

Optionally, the sheet member 124 may have indicia such as writing on the upper surface thereof. Such indicia may include the words Winterized, Stop, Do Not Use, and/or Out of Order. Such indicia may be provided in the form of a stick-on label such as that shown in FIG. 8.

The sheet member 124 may be provided as a translucent tinted sheet allowing a selected level of visibility, such as approximately 35% light transmittance, which reduces the light by an amount sufficient to prevent algae growth inside of the toilet bowl 110. Alternatively, the sheet member 24 may be provided as an opaque sheet.

As previously described in connection with the first embodiment, the apparatus may include a peel-away cover sheet 36 covering the adhesive lower side 128 of the sheet member 124. Where used, this peel-away cover sheet 36 is removed before installation, to allow the sheet member 124 to removably stick to the upper surface of the toilet bowl 110.

The cover apparatus 120 according to the second embodiment is installed on a toilet bowl 110 in the same way as the cover apparatus 20 of the first embodiment.

The cover apparatus 120 provides an excellent long-term seal for the toilet bowl 110, but the apparatus may be easily removed from a toilet bowl when desired, by lifting it up from one end.

A different, modified embodiment of the invention may be configured to cover a sink during periods of non-use, and such modified embodiment may be made in a shape to correspond to the contours of the sink.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the present claims, are intended to be within the scope and spirit of the present invention.

I claim:

1. A protective cover apparatus for use on a toilet having a toilet bowl and a seat, said cover apparatus comprising:

an arcuate frame member configured to surround or fit on top of the toilet bowl below the seat; and a flexible plastic sheet member having a shape configured to fit on the frame member, the sheet member having an upper side and a lower side with a sticky adhesive material thereon, wherein outer edge portions of the sheet member are wrapped around the frame member and attached to the lower side of the sheet member, wherein the cover apparatus is configured to adhesively attach to an upper surface of the toilet bowl to substantially seal the bowl and minimize water evaporation therefrom during periods of non-use.

2. The protective cover apparatus of claim 1, wherein the sheet member has indicia on the upper surface thereof.

3. The protective cover apparatus of claim 1, further comprising a peel-away cover sheet attached to the lower side of the sheet member.

4. The protective cover apparatus of claim 1, wherein the sheet member comprises a translucent tinted sheet.

5. The protective cover apparatus of claim 1, wherein the sheet member comprises an opaque sheet with indicia thereon.

6. The protective cover apparatus of claim 1, wherein the frame member has a first end and a second end, and further comprising a safety line extending between and interconnecting the first and second ends of the frame member.

7. A protective cover apparatus for use on a toilet having a toilet bowl and a seat, said cover apparatus comprising:

an arcuate frame member configured to surround or fit on top of the toilet bowl below the seat, the frame member being formed substantially in a horseshoe shape having a first end and a second end, wherein the frame member is formed from a flexibly resilient material;

a safety line interconnecting the first and second ends of the frame member, a flexible plastic sheet member having a shape configured to fit on the frame member, the sheet member having an upper side and a lower side with a sticky adhesive material thereon, wherein outer edge portions of the sheet member are wrapped around the frame member and attached to the lower side of the sheet member, wherein the cover apparatus is configured to adhesively attach to an upper surface of the toilet bowl to substantially seal the bowl and minimize water evaporation therefrom during periods of non-use.

8. The protective cover apparatus of claim 7, wherein each of the first and second ends of the frame member is bent around to form an eyelet, and wherein each end of the safety line is passed through the one of the eyelets of the frame member and attached to itself by a crimp connection to form a loop.

9. The protective cover apparatus of claim 8, further comprising a peel-away cover sheet attached to the lower side of the sheet member.

10. The protective cover apparatus of claim 7, wherein the sheet member has indicia on the upper surface thereof.

11. The protective cover apparatus of claim 7, further comprising a peel-away cover sheet attached to the lower side of the sheet member.

12. The protective cover apparatus of claim 7, wherein the sheet member comprises a translucent tinted sheet.

13. The protective cover apparatus of claim 7, wherein the sheet member comprises an opaque sheet with indicia thereon.

14. A method of installing a protective cover apparatus on a toilet having a toilet bowl and a seat, the method comprising the steps of:

cleaning an upper surface of the toilet bowl;

aligning the protective cover apparatus over an upper surface of the toilet bowl with an adhesive side facing downwardly, placing the cover apparatus on upper surface of the toilet bowl; and pressing the cover apparatus against the upper surface of the toilet bowl in a manner such that the sheet member becomes sealingly attached to the upper surface of the toilet bowl.

15. The method of claim 14, further comprising a step of removing a protective cover sheet from a sheet member of the protective cover before the alignment step.

16. The method of claim 14, wherein the protective cover apparatus is the apparatus of claim 1.

17. The method of claim 14, wherein the protective cover apparatus is the apparatus of claim 7.

* * * * *